United States Patent [19]

Leonardo

[11] Patent Number: 4,944,683

[45] Date of Patent: Jul. 31, 1990

[54] GROUNDING CLAMP

[75] Inventor: Ignazio E. Leonardo, Union, N.J.

[73] Assignee: A K Stamping Co., Inc., Mountainside, N.J.

[21] Appl. No.: 435,337

[22] Filed: Nov. 13, 1989

[51] Int. Cl.[5] ..... H01R 4/66

[52] U.S. Cl. ..... 439/96; 24/279; 248/74.3

[58] Field of Search ..... 248/74.3, 74.1, 74.2, 248/74.4, 74.5, 73, 60, 62, 49; 24/279, 280, 281; 439/96, 100, 799, 800

[56] References Cited

U.S. PATENT DOCUMENTS

| | | | |
|---|---|---|---|
| 312,755 | 2/1885 | Patterson | 439/799 X |
| 944,752 | 12/1909 | Vogel | 439/799 |
| 1,171,142 | 2/1916 | Rosen | 439/799 |
| 1,205,374 | 11/1916 | Marcus | 439/799 |
| 4,664,469 | 5/1987 | Sachs | 439/100 X |
| 4,863,390 | 9/1989 | Cera et al. | 439/100 |

FOREIGN PATENT DOCUMENTS

| | | | |
|---|---|---|---|
| 0603069 | 3/1960 | Italy | 248/74.3 |
| 0274210 | 9/1964 | Netherlands | 248/74.3 |
| 0181112 | 6/1922 | United Kingdom | 439/799 |

*Primary Examiner*—Ramon O. Ramirez

[57] ABSTRACT

A grounding clamp for grounding a ground wire to a grounding rod includes a strap, a segment of which is to be looped around the grounding rod and secured and connected electrically to the grounding rod by a stud having a head for passing through a selected one of a plurality of slots in the strap, spaced along the length of the strap, and a screw-threaded end for passing through a hole in a confronting portion of the looped segment of the strap for engagement by a nut which may be operated to draw the stud in a direction tending to close the looped segment, the head including an opening for receiving the ground wire outside the looped segment such that upon operating the nut to draw the stud in the direction tending to close the looped segment, the ground wire will be clamped against the strap in direct electrical contact with the strap.

18 Claims, 2 Drawing Sheets

GROUNDING CLAMP

The present invention relates generally to grounding devices and pertains, more specifically, to grounding clamps used in the connection of ground wires in various electrical circuits, such as in the installation of telephone circuits, cable television circuits, and certain electrical power distribution systems.

A wide variety of grounding clamps have been developed for making ground connections in electrical installations of all kinds. The basic requirement of these grounding clamps is to enable the establishment of a good ground connection with minimum complexity both in the apparatus and in the procedures required to complete a particular installation. Among the various installations in which relatively large numbers of ground connections routinely are required are telephone circuits which demand high-quality ground connections that can be accomplished quickly and effectively with minimal effort and expense.

The present invention provides a grounding clamp construction which fills the need for accomplishing ground connections in the manner outlined above and attains several objects and advantages, some of which are summarized as follows: Accomplishes improved electrical contact for a good ground connection with minimal effort on the part of the installer; provides a self-contained device in which all of the component parts of the grounding clamp are delivered to the installation site as a unit, thereby eliminating loose parts which otherwise might require the inconvenience of location and assembly in the field; enables simplified installation procedures assuring effective ground connections with increased ease; accommodates an extended range of sizes in both the ground wire and the grounding member to which the ground wire is to be clamped; ensures a more positive electrical ground connection; provides a more secure mechanical connection for the ground wire; reduces installation time and tool requirements for increased efficiency and reduced installation costs; and provides a simplified construction requiring a minimum number of component parts of reduced complexity for economical manufacture in large numbers of high quality.

The above objects and advantages, as well as further objects and advantages, are accomplished by the present invention, which may be described briefly as a grounding clamp for connecting and clamping a selected ground conductor to a grounding member, the selected ground conductor having a particular size selected from a range of sizes capable of being accommodated in the grounding clamp, the grounding clamp comprising: an elongate strap of electrically conductive material having opposite first and second faces, a length extending longitudinally between opposite first and second ends and including an aperture passing through the strap adjacent the first end of the strap, the aperture having a peripheral configuration along the perimeter thereof, and a plurality of slots passing through the strap and spaced longitudinally along the length of the strap between the aperture and the second end of the strap, each of the slots having a peripheral configuration along the perimeter thereof; a stud having axially opposite first and second ends and including a head adjacent the first end, and fastener means adjacent the second end, the relative dimensions of the aperture and the fastener means being such that fastener means may be passed through the aperture, and the relative dimensions of each aperture and the head being such that the head may be passed through any selected one of the slots; and a passage extending transversely into the head and having a size great enough to receive the selected ground conductor; whereby, upon looping at least a segment of the strap around the grounding member and bringing the aperture into juxtaposition with the selected one of the slots, portions of the first face of the strap will confront one another adjacent the looped segment of the strap, and the stud will pass through the aperture and through the selected one of the slots, with the fastener means and the head placed adjacent to and extending axially beyond corresponding portions of the second face of the strap, thereby enabling insertion of the ground conductor into the passage with the ground conductor juxtaposed with the corresponding portion of the second face of the strap and extending transversely beyond the perimeter of the selected one slot so that operation of the fastener means to draw the stud in the direction from the first end toward the second end will tend to close the looped segment of the strap around the grounding member and clamp the ground conductor against the corresponding portion of the second face of the strap in direct electrical contact with the strap.

The invention will be understood more fully, while still further objects and advantages will become apparent, in the following detailed description of a preferred embodiment of the invention illustrated in the accompanying drawing, in which.

Figure 1:
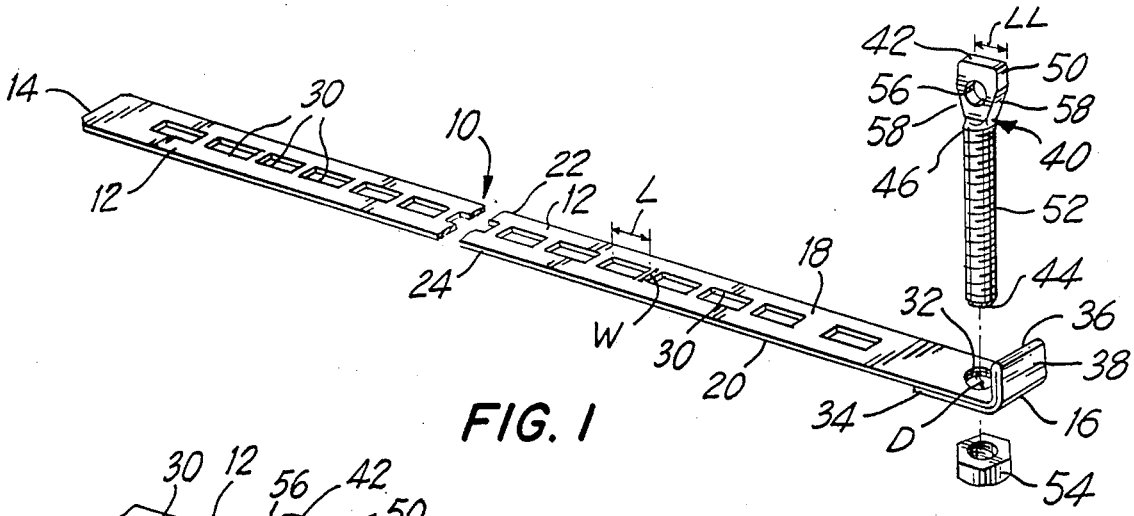
FIG. 1 is an exploded perspective view of a grounding clamp constructed in accordance with the invention.

Referring now to the drawing, and especially to FIG. 1 thereof, a grounding clamp constructed in accordance with the invention is illustrated generally at 10 and is seen to have an elongate strap 12 constructed of an electrically conductive material, such as copper. Strap 12 extends longitudinally between a first end 14 and an opposite second end 16, and includes opposite faces shown in the form of essentially planar, parallel first or inner and second or outer faces 18 and 20, respectively, which inner and outer faces 18 and 20 extend longitudinally between the opposite ends 14 and 16, and laterally between opposite side edges 22 and 24. Thus, strap 12 is in the form of a relatively thin, elongate band of material which is bent readily into a looped configuration, as will be explained in greater detail below.

A plurality of slots 30 pass through the strap 12 at locations spaced apart along the length of the strap 12 between the ends 14 and 16, and an aperture in the form of a hole 32 passes through the strap 12 adjacent the end 16 of the strap 12. The slots 30 each have a peripheral configuration of given dimensions. In the illustrated embodiment, the peripheral configuration is a rectangle and the given dimensions include a length L and a width W, the maximum dimension of each slot 30 being in the form of length L of the rectangle. Hole 32 also has a peripheral configuration of given dimensions, the peripheral configuration of hole 32 being a circle having a diameter D. The material of strap 12 is bent back upon itself at the second end 16 to establish an end segment 34 reinforced by a double thickness of material, and hole 32 is located in segment 34. Segment 34 is itself bent along bend line 36 to establish a heel 38 at end 16 of the strap 12, heel 38 preferably extending normal to the planes of the opposite faces 18 and 20, for purposes which will be explained in greater detail below.

Figure 2:
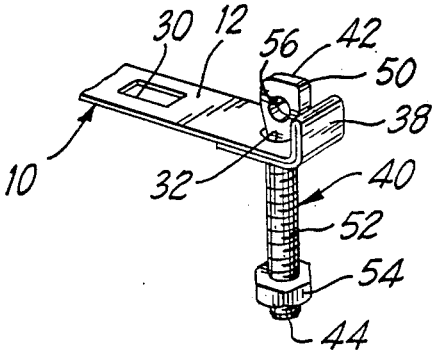
FIG. 2 is a fragmentary perspective view of a portion of the grounding clasp showing some of the component parts assembled.

A stud 40 constructed of an electrically conductive material, such as brass, extends axially between opposite ends 42 and 44 and includes a generally cylindrical shank 46 having a diameter essentially complementary to the hole 32 so that the shank 46 is readily received within the hole 32, as illustrated in FIG. 2. A head 50 is placed at end 42 of the stud 40 and a fastener element in the form of a screw thread 52 is located at end 44. The relative dimensions of the screw thread 52 and the hole 32 enable shank 46 of the stud 40 to be passed through the hole 32; however, the relative dimensions of the head 50 and the hole 32 are such that the head 50 will not pass through the hole 32. Thus, the head 50 has a generally rectangular cross-sectional configuration, the length LL of which is greater than the diameter D of hole 32 so that when the shank 46 is inserted into the hole 32, the head 50 will preclude passage of the stud 40 completely through the hole 32. Once the screw thread 52 is passed through the hole 32, a complementary fastener element, shown in the form of a nut 54, is threaded loosely onto the screw thread 52 to capture the stud 40 within the hole 32, as seen in FIG. 2. In this manner, the grounding clamp 10 is delivered to an installation site as a unit, with all of the component parts of the grounding clamp held together, immediately ready for installation, without requiring the assembly of loose parts in the field. Head 50 includes a passage in the form of an opening 56 extending transversely through the head 50 and a profile configuration tapered at 58 so as to converge in the direction from end 42 toward end 44, for purposes which will be described in detail below.

Figure 3:
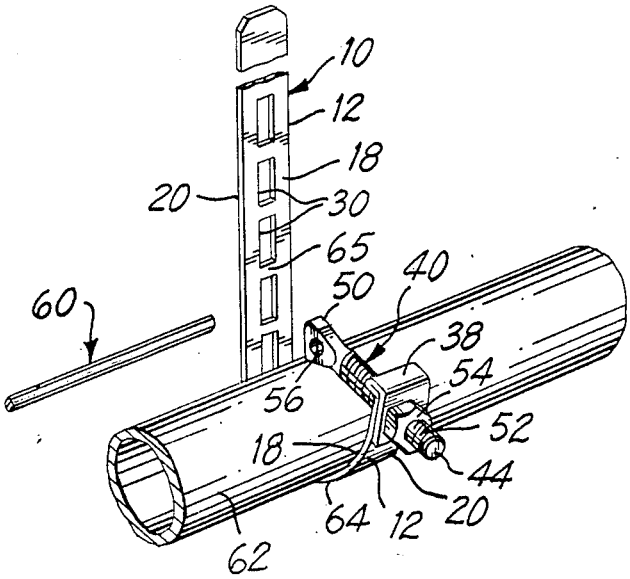
FIG. 3 is a perspective view illustrating the installation of the grounding clamp on a grounding rod.

Turning now to FIG. 3, grounding clamp 10 is to be used in connecting and securing a ground conductor, here shown in the form of ground wire 60, to a grounding member, usually in the form of a grounding rod 62. In order to install grounding clamp 10, a segment 64 of strap 12 is looped around the perimeter of grounding rod 62, segment 64 being adjacent end 16 of the strap 12, so that the heel 38 projects toward an intermediate portion 65 of inner face 18 and portions of the inner face 18 of the strap confront one another to juxtapose and align the hole 32 with one of the slots 30, as shown. The rectangular cross-sectional configuration of head 50 of the stud 40 is essentially complementary to the peripheral configuration of the slots 30, so that head 50 may be slipped through the one slot 30 juxtaposed with the hole 32 until the opening 56 is placed adjacent the outside face 20 of the strap 12. The selection of a particular slot 30 to be juxtaposed with the hole 32 is determined by the peripheral length of the grounding member, which, in the illustrated installation, is the circumference of the grounding rod 62. Generally, grounding rod 62 is one of a plurality of grounding rods available in different sizes and the length of strap 12 is such that a range of different sizes of grounding rods is accommodated. To that end, slots 30 are spaced apart along the strap 12 in increments which define segments 64 having lengths capable of accommodating the perimeters of cylindrical grounding rods within the range of standard sizes encountered in the field.

Figure 4:
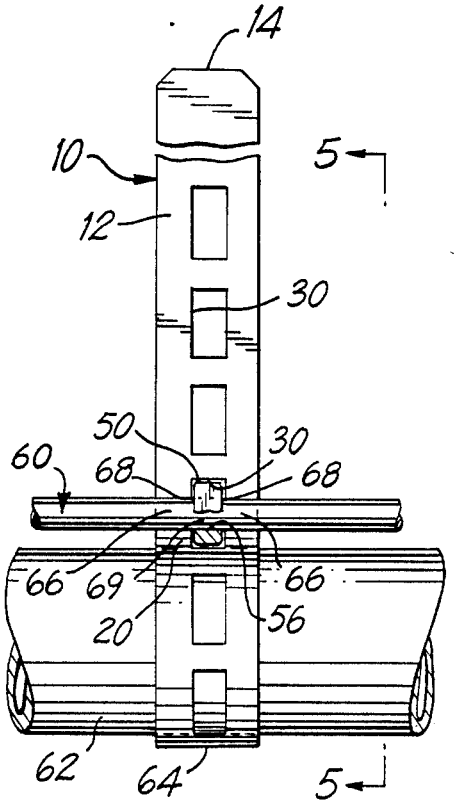
FIG. 4 is an elevational view showing the grounding clamp installed upon the grounding rod.
Figure 5:
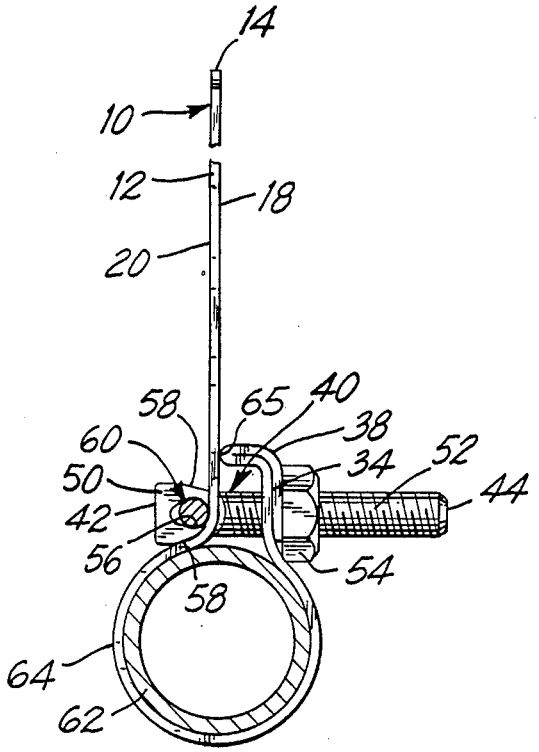
FIG 5 is a cross-sectional view taken along line 5—5 of FIG. 4.

As best seen in FIGS. 4 and 5, once the head 50 is slipped through the appropriate slot 30, ground wire 60 is inserted through opening 56 in the head 50, the insertion preferably being such that a length 66 of ground wire 60 projects transversely from each side 68 of the head 50 and is juxtaposed with the outer face 20 of the strap 12. Preferably, the ground wire 60 is oriented parallel to the longitudinal extent of the grounding rod 62 and extends laterally across the strap 12, as shown. Nut 54 is then advanced along the screw thread 52 in the direction toward the head 50, simultaneously drawing the head 50 toward the outer face 20 and urging the heel 38 against the intermediate portion 65 of inner face 18 of the strap 12. Upon tightening of the nut 54, the lengths 66 of ground wire 60 will be clamped against the outer face 20 of the strap 12 in direct electrical contact with the strap 12 and the portion 69 of the ground wire 60 intermediate lengths 66 and lying within the opening 56 will be gripped securely by the head 50 of the stud 40. Preferably, locking of the ground wire 60 in place is enhanced by a slight deformation of the portion 69 in response to the forces exerted upon the portion 69 by the head 50 of the stud 40. At the same time, the heel 38 will assure that the clamping of the ground wire 60 is mechanically secure for maintaining effective contact between the ground wire 60 and the strap 12. In addition, the looped segment 64 will be conformed closely to the grounding rod 62 for effective mechanical connection as well as good electrical contact. The tapered profile configuration 58 of the head 50 enables the head 50 to follow essentially the conformed configuration of the looped segment 64 of the strap 12 so as to enhance the fit of the grounding clamp 10 on the grounding rod 62.

Figure 6:
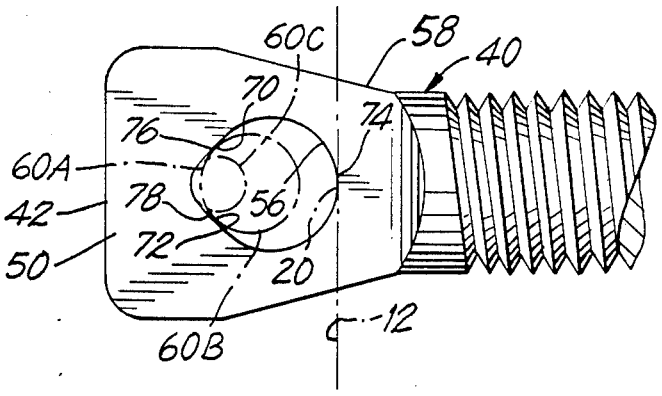
FIG. 6 is an enlarged fragmentary view, partially diagrammatic, of the head end of the stud of the grounding clamp.

Referring now to FIG. 6, opening 56 preferably is provided with a generally ovate peripheral configuration and includes opposed contact surfaces 70 and 72 which converge toward one another in the direction from end 44 toward end 42. As the stud 40 is drawn in the direction from and 42 toward end 44, the ground wire 60 will be wedged between the converging contact surfaces 70 and 72 and urged against the outer face 20 of the strap 12. In this manner, electrical contact is made at three points around the perimeter of the ground wire 60, as illustrated diagrammatically at points 74, 76 and 78. The generally ovate configuration of the opening 56 assures that this effective three-point contact is attained with ground wires of different sizes, within the size range accommodated by the maximum and minimum dimensions of the opening 56, as shown by the phantom illustration of alternate ground wires 60A, 60B and 60C of different diameters.

It will be seen that the construction and installation of grounding clamp 10 is exceptionally convenient and very simple. The grounding clamp 10 is supplied in a unit, with all of the component parts assembled and ready for installation, without the necessity for assembling loose parts in the field, prior to installing the device on a grounding member. The strap 12 merely is looped around the grounding rod 62, the head 50 of the stud 40 is slipped through a selected slot 30, the ground wire 60 is passed through the opening 56, and the nut 54 is tightened. It is noted that engagement of the complementary rectangular configurations of the slot 30 and the inserted head 50 of stud 40 assures that the stud will not turn during tightening of the nut 54, thereby facilitating installation with a minimal requirement for tools. In addition, the rectangular configuration of slots 30, and the orientation of the slots 30 with the lengths L aligned parallel with the longitudinal direction, assures that there is sufficient material in the strap 12 around the slots 30, as compared to equivalent, wider round openings, to resist kinking of the strap 12 in the vicinity of the selected slot 30, and the concomitant adverse effects of such kinking on the electrical connection between the ground wire 60 and the strap 12, even with ground wires of smaller diameters, while at the same time providing an extended surface for good electrical contact between the transversely-projecting lengths 66 of ground wire 60 and strap 12.

It will be seen that grounding clamp 10 attains the several objects and advantages set forth above, namely, the device accomplishes improved electrical contact for a good ground connection with minimal effort on the part of the installer; provides a self-contained device in which all of the component parts of the grounding clamp are delivered to the installation site as a unit, thereby eliminating loose parts which otherwise might require the inconvenience of location and assembly in the field; enables simplified installation procedures assuring effective ground connections with increased ease; accommodates an extended range of sizes in both the ground wire and the grounding member to which the ground wire is to be clamped; ensures a more positive electrical ground connection; provides a more secure mechanical connection for the ground wire; reduces installation time and tool requirements for increased efficiency and reduced installation costs; and provides a simplified construction requiring a minimum number of component parts of reduced complexity for economical manufacture in large numbers of high quality.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A grounding clamp for connecting and clamping a selected ground conductor to a grounding member, the selected ground conductor having a particular size selected from a range of sizes capable of being accommodated in the grounding clamp, the grounding clamp comprising:

an elongate strap of electrically conductive material having opposite first and second faces, a length extending longitudinally between opposite first and second ends and including an aperture passing through the strap adjacent the second end of the strap, the aperture having a peripheral configuration along the perimeter thereof, and a plurality of slots passing through the strap and spaced longitudinally along the length of the strap between the aperture and the first end of the strap, each of the slots having a peripheral configuration along the perimeter thereof;

a stud having axially opposite first and second ends and including a head adjacent the first end, and fastener means adjacent the second end, the relative dimensions of the aperture and the fastener means being such that fastener means may be passed through the aperture, and the relative dimensions of each slot and the head being such that the head may be passed through any selected one of the slots; and a passage extending transversely into the head and having a size great enough to receive the selected ground conductor;

whereby, upon looping at least a segment of the strap around the grounding member and bringing the aperture into juxtaposition with the selected one of the slots, portions of the first face of the strap will confront one another adjacent the looped segment of the strap, and the stud will pass through the aperture and through the selected one of the slots, with the fastener means and the head placed adjacent to and extending axially beyond corresponding portions of the second face of the strap, thereby enabling insertion of the ground conductor into the passage with the ground conductor juxtaposed with the corresponding portion of the second face of the strap and extending transversely beyond the perimeter of the selected one slot so that operation of the fastener means to draw the stud in the direction from the second end toward the first end will tend to close the looped segment of the strap around the grounding member and clamp the ground conductor against the corresponding portion of the second face of the strap in direct electrical contact with the strap.

2. The invention of claim 1 wherein the aperture comprises a hole in the strap and the relative dimensions of the hole in the strap and the head of the stud are such that the head will not pass through the hole.

3. The invention of claim 1 wherein the grounding member is selected from grounding members of different sizes within a range of sizes, and the slots are spaced along the length of the strap in increments which define lengths of the looped segment corresponding to the sizes of the grounding member within the range of sizes.

4. The invention of claim 3 wherein the peripheral configuration of each slot is a rectangle.

5. The invention of claim 4 wherein the rectangle has a length greater than the width of the rectangle, and each slot is oriented with the length thereof aligned longitudinally along the strap.

6. The invention of claim 4 wherein the head of the stud has a rectangular peripheral configuration generally complementary with the rectangle of the peripheral configuration of each slot.

7. The invention of claim 6 wherein the passage in the head of the slot includes an opening passing through the head.

8. The invention of claim 7 wherein the stud is constructed of an electrically conductive material and the opening includes a perimeter and contact surfaces along the perimeter of the opening, the contact surfaces converging in the direction from the second end of the stud toward the first end of the stud and being spaced apart from one another for the reception of the ground conductor selected from the range of sizes, such that upon drawing the stud in the direction from the first end toward the second end of the stud each contact surface will make electrical contact with the ground conductor.

9. The invention of claim 8 wherein the opening has a generally ovate peripheral configuration.

10. The invention of claim 1 including a heel located adjacent the first end of the strap and extending generally normal to the longitudinal length of the strap between the aperture and the first end.

11. The invention of claim 1 wherein the faces of the strap are generally planar.

12. The invention of claim 1 wherein the fastener means comprises a screw thread extending along the stud adjacent the second end of the stud, the invention including a nut for being threaded upon the screw thread.

13. The invention of claim 1 wherein the peripheral configuration of each slot is a rectangle.

14. The invention of claim 13 wherein the rectangle has a length greater than the width of the rectangle, and each slot is oriented with the length thereof aligned longitudinally along the strap.

15. The invention of claim 13 wherein the head of the stud has a rectangular peripheral configuration generally complementary with the rectangle of the peripheral configuration of each slot.

16. The invention of claim 1 wherein the passage in the head of the stud includes an opening passing through the head.

17. The invention of claim 16 wherein the stud is constructed of an electrically conductive material and the opening includes a perimeter and contact surfaces along the perimeter of the opening, the contact surfaces converging in the direction from the second end of the stud toward the first end of the stud and being spaced apart from one another for the reception of the ground conductor selected from the range of sizes, such that upon drawing the stud in the direction from the first end toward the second end of the stud each contact surface will make electrical contact with the ground conductor.

18. The invention of claim 17 wherein the opening has a generally ovate peripheral configuration.

* * * * *